US010512812B2

(12) United States Patent
Krull et al.

(10) Patent No.: US 10,512,812 B2
(45) Date of Patent: Dec. 24, 2019

(54) EXERCISE RESISTANCE METHODS AND APPARATUS

(71) Applicants: Mark A. Krull, New Braunfels, TX (US); Stephen P. Ihli, Santa Monica, CA (US)

(72) Inventors: Mark A. Krull, New Braunfels, TX (US); Stephen P. Ihli, Santa Monica, CA (US)

( * ) Notice: Subject to any disclaimer, the term of this patent is extended or adjusted under 35 U.S.C. 154(b) by 258 days.

(21) Appl. No.: 15/477,210

(22) Filed: Apr. 3, 2017

(65) Prior Publication Data

US 2018/0280753 A1 Oct. 4, 2018

(51) Int. Cl.

| | |
|---|---|
| ***A63B 21/015*** | (2006.01) |
| ***A63B 21/00*** | (2006.01) |
| ***A63B 23/035*** | (2006.01) |
| ***A63B 21/02*** | (2006.01) |

(52) U.S. Cl.

CPC ..... *A63B 21/015* (2013.01); *A63B 21/00043* (2013.01); *A63B 21/00069* (2013.01); *A63B 21/025* (2013.01); *A63B 21/153* (2013.01); *A63B 21/157* (2013.01); *A63B 21/4035* (2015.10); *A63B 21/4043* (2015.10); *A63B 23/03541* (2013.01); *A63B 21/00185* (2013.01)

(58) Field of Classification Search

None

See application file for complete search history.

(56) References Cited

U.S. PATENT DOCUMENTS

| | | | | |
|---|---|---|---|---|
| 766,743 | A | 8/1904 | Terry | |
| 913,799 | A | 3/1909 | Burguet | |
| 1,390,095 | A | 9/1921 | Dettinger | 607/78 |
| 1,573,362 | A | 2/1926 | Stovall | 482/148 |
| 1,954,762 | A | 3/1932 | Wolff | 482/127 |
| 2,951,702 | A | 5/1958 | Goodwin | 482/127 |
| 2,959,414 | A | 6/1958 | Saltz | 482/127 |
| 3,610,617 | A | 10/1971 | Hepburn | 482/116 |
| 3,841,627 | A | 10/1974 | Vetter | 482/110 |
| 3,885,789 | A | 5/1975 | Deluty | 482/120 |
| 4,174,832 | A | 11/1979 | Thompson | 482/120 |
| 4,328,965 | A | 5/1982 | Hatfield | 482/122 |
| 4,625,962 | A | 12/1986 | Street | 482/116 |
| 4,779,866 | A | 10/1988 | Marshall | 482/116 |
| 4,948,119 | A | 8/1990 | Robertson | 482/56 |
| 5,147,264 | A * | 9/1992 | Braathen | A63B 21/015 482/118 |
| 5,195,937 | A | 3/1993 | Engel | 482/119 |
| 5,226,867 | A | 7/1993 | Beal | 482/127 |
| 5,292,293 | A | 3/1994 | Schumacher | 482/4 |
| 5,302,161 | A | 4/1994 | Loubert | 482/8 |

(Continued)

*Primary Examiner* — Joshua Lee

(57) ABSTRACT

An exercise apparatus includes a cable that is extracted from a housing when the extraction force is sufficient to rotate a drum that is rotatably mounted within the housing. A brake material is sandwiched between the drum and at least one tension band to provide adjustable resistance to rotation of the drum. A knob is rotated to adjust tension in the at least one tension band without affecting tension in the brake material. Indicia associated with rotation of the knob show changes in the resistance level as the knob rotates through more than one complete revolution relative to the housing. In the absence of user applied force, a rewind spring draws the cable back into the housing.

15 Claims, 21 Drawing Sheets

(56) References Cited

U.S. PATENT DOCUMENTS

| | | | | |
|---|---|---|---|---|
| 5,324,243 | A | 6/1994 | Wilkinson | 482/92 |
| 5,358,461 | A | 10/1994 | Bailey | 482/2 |
| 5,397,285 | A | 3/1995 | Haan et al. | 482/61 |
| 5,437,591 | A | 8/1995 | Chen | 482/127 |
| 5,486,149 | A | 1/1996 | Smith | 482/120 |
| 5,509,873 | A | 4/1996 | Corn | 482/74 |
| 5,618,249 | A | 4/1997 | Marshall | 482/127 |
| 5,709,637 | A | 1/1998 | Gow | 482/129 |
| 5,733,231 | A | 3/1998 | Corn | 482/120 |
| 5,755,646 | A | 5/1998 | Chu | 482/118 |
| 5,792,034 | A | 8/1998 | Kozlovsky | 482/124 |
| 5,876,310 | A | 3/1999 | Mackey | 482/74 |
| 6,099,447 | A | 8/2000 | Ramsaroop | 482/127 |
| 6,149,559 | A | 11/2000 | Mackey | 482/124 |
| 6,283,899 | B1 | 9/2001 | Charnitski | 482/110 |
| 6,315,701 | B1 | 11/2001 | Shifferaw | 482/114 |
| 6,544,152 | B2 | 4/2003 | Rosati | 482/126 |
| D487,123 | S | 2/2004 | Ihli | D21/684 |
| 6,726,607 | B1 | 4/2004 | Ihli | 482/127 |
| 6,770,014 | B2 | 8/2004 | Amore | 482/92 |
| 7,087,001 | B1 | 8/2006 | Ihli | 482/115 |
| 7,250,021 | B2 | 7/2007 | Leight | 482/116 |
| 7,322,909 | B1 | 1/2008 | Loccarini | 482/129 |
| 8,007,420 | B2 * | 8/2011 | Mullin | A63B 21/00069 482/124 |
| 8,465,401 | B1 | 6/2013 | Ihli | 482/126 |
| 8,523,745 | B1 | 9/2013 | Ihli | 482/140 |
| 8,556,783 | B1 | 10/2013 | Ihli | 482/115 |
| 8,556,785 | B1 | 10/2013 | Ihli | 482/126 |
| 8,622,879 | B1 | 1/2014 | Ihli | 482/124 |
| 8,845,499 | B1 * | 9/2014 | Boatwright | A63B 21/015 482/116 |
| 8,998,779 | B1 | 4/2015 | Ihli | 482/115 |
| 10,143,880 | B1 * | 12/2018 | Boatwright | A63B 21/153 |
| 2003/0087735 | A1 * | 5/2003 | Chen | A63B 21/025 482/116 |
| 2003/0153441 | A1 | 8/2003 | Berns | 482/128 |
| 2003/0211920 | A1 | 11/2003 | Mandel | 482/116 |
| 2004/0102292 | A1 * | 5/2004 | Pyles | A63B 21/0051 482/54 |
| 2006/0040805 | A1 | 2/2006 | Wilkinson | 482/124 |
| 2010/0137105 | A1 | 6/2010 | McLaughlin | 482/8 |
| 2015/0011368 | A1 * | 1/2015 | Manor | A63B 21/0051 482/116 |

* cited by examiner

EXERCISE RESISTANCE METHODS AND APPARATUS

CROSS-REFERENCE TO RELATED APPLICATIONS

Disclosed herein is subject matter that is entitled to the filing dates of U.S. Provisional Application No. 62/318,250, filed Apr. 5, 2016, and U.S. Provisional Application No. 62/319,266, filed Apr. 6, 2016.

FIELD OF THE INVENTION

The present invention relates to exercise equipment, including the provision of selectively adjustable resistance to exercise motion, preferably using a brake drum, a brake band, and a brake strip sandwiched therebetween.

BACKGROUND OF THE INVENTION

A variety of exercise devices have been developed to resist exercise motion. Examples are disclosed in U.S. Pat. Nos. 6,726,607 and 7,087,001 to Ihli, and in U.S. Pat. Nos. 8,465,410, 8,523,745, 8,556,783, 8,556,785, 8,622,879, and 8,998,779 to Ihli et al. An object of the present invention is to provide improved versions of such exercise resistance devices and methods of using same.

SUMMARY OF THE INVENTION

An exercise resistance device has a brake drum rotatably mounted on a frame; at least one tension band disposed at least partially about the perimeter of the drum; at least one brake strip sandwiched between the tension band(s) and the brake drum; a tension adjustment mechanism interconnected between the tension band(s) and the frame; and a force receiving member operatively connected to the drum in such a manner that movement of the force receiving member is linked to rotation of the drum.

A feature of the present invention is that the brake strip is preferably arranged so adjustments to tension in the tension band(s) do not affect tension in the brake strip. The brake strip preferably has one end secured to the drum and the other end moveable to accommodate length changes in the brake strip during operation of the device. Each end of the brake strip preferably occupies a respective slot or slot compartment defined by the drum. The brake strip is preferably made of para-aramid synthetic fiber, and may be described as a Kevlar™ webbing strap.

Another feature of the present invention is the provision of diametrically opposed first and second tension bands. Each band preferably has a first end connected to the frame, and a second end connected to a respective nut. The bands preferably intertwine with one another at diametrically opposed first and second locations. The nuts are preferably threaded onto respective ends of an adjustment bolt rotatably mounted on the frame. One nut and associated end of the bolt is reverse-threaded relative to the other nut and associated end of the bolt, and both nuts bear laterally against the frame. As a result, the nuts are constrained to move in opposite directions in response to rotation of the bolt.

Yet another feature of the present invention is the provision of a housing about the drum. The housing may define a shell that fits into a person's hand, in which case a strap is preferably secured between opposite first and second sides of the housing to extend across the back of the person's hand when the shell is held in the person's hand.

The foregoing features of the present invention may be practiced individually and/or in any combination with one another and/or with other features that will become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

In a certain respect, the present invention may be described in terms of improvements to the exercise apparatus disclosed in U.S. Pat. Nos. 6,726,607 and 7,087,001 to Ihli, and U.S. Pat. Nos. 8,465,410, 8,523,745, 8,556,783, 8,556,785 8,622,879, and 8,998,779 to Ihli et al., all of which are incorporated herein by reference to contribute to understanding of the construction, operation, and/or use of the present invention. As a result, the following description focuses primarily on distinctions between these prior art devices and the present invention, and takes into account the fact that shared attributes are already disclosed in the above-referenced patents. Nonetheless, the features of the present invention may also be implemented on or in connection with other types of exercise apparatus, as well.

Figure 1:
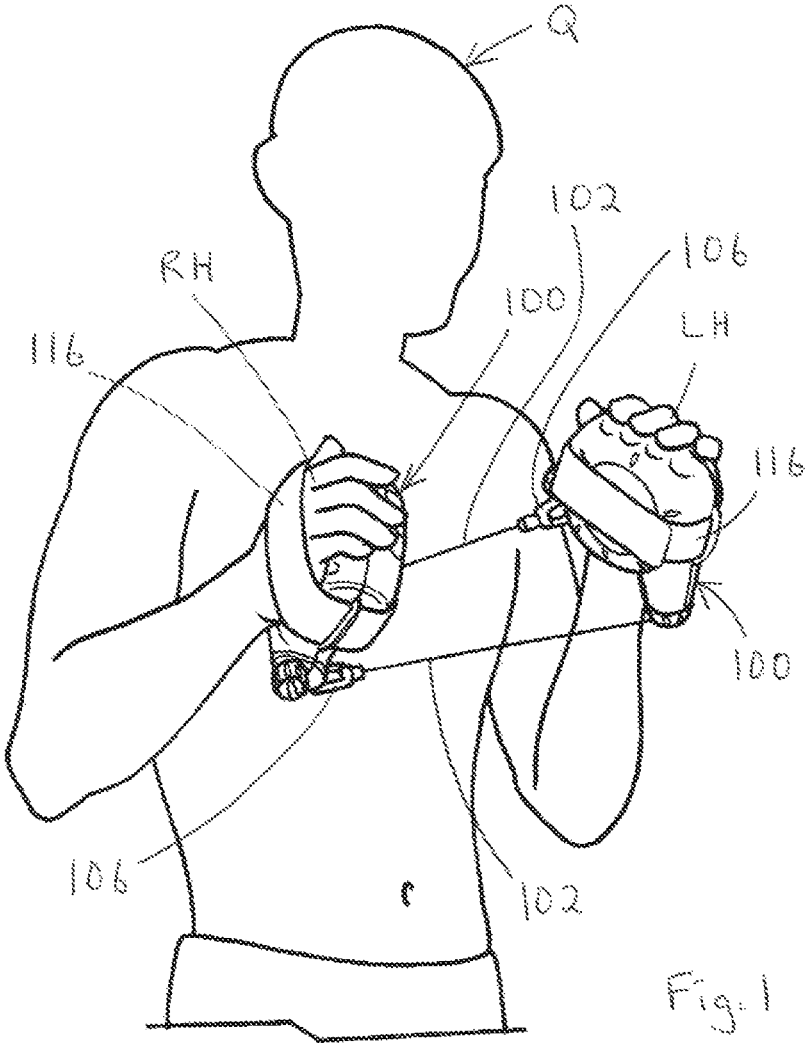
FIG. 1 is a diagrammatic view of a person exercising with two identical units of a preferred embodiment exercise apparatus constructed according to the principles of the present invention.

FIG. 1 shows an adult male Q exercising with two identical units 100 of an exercise apparatus constructed according to the principles of the present invention. One unit 100 fits into the palm of the person's left hand LH, and includes a strap 116 that wraps about the back of the person's left hand LH. The other unit fits into the palm of the person's right hand RH, and includes a strap 116 that wraps about the back of the person's left hand RH. The units 100 are shown connected to one another in a manner that accommodates various upper body exercises. In this regard, a cord 102 emanates from the left hand unit 100; a carabineer 106 is secured to the end of this cord 102; and this carabineer 106 is connected to an eyelet on the other, right hand unit 100. Similarly, a cord 102 emanates from the right hand unit 100; a carabineer 106 is secured to the end of this cord 102; and this carabineer 106 is connected to an eyelet on the other, left hand unit 100. This arrangement of the two units 100 is only one example of how the subject invention may be used for exercise purposes. For example, various force receiving members may be connected to the carabineer 106 on a unit 100, and/or a unit 100 may be supported by various elements other than a person's hand, including, for example, a body harness, a platform, a bench, a bed, or a post.

Various components of one of the units 100 are shown in FIGS. 2-14 (all of which are drawn to scale). Each unit or apparatus 100 preferably includes a frame comprising an injection molded front housing or shell half 120, an injection molded rear housing or shell half 140, and a stamped steel bracket 160 sandwiched between the housings 120 and 140. In this regard, five threaded inserts 114 (see FIG. 4) are secured in respective receptacles 144 in the rear housing 140 (see FIG. 8), and five screws 112 (see FIG. 3) are inserted through holes 122 in the front housing 120 (see FIG. 5), and through holes 162 in or past edges of the bracket 160 (see FIG. 12), and threaded into the inserts 114. FIG. 5 shows the front housing 120 by itself; FIG. 8 shows the rear housing 140 by itself; and FIG. 12 shows the bracket 160 by itself.

Figure 2:
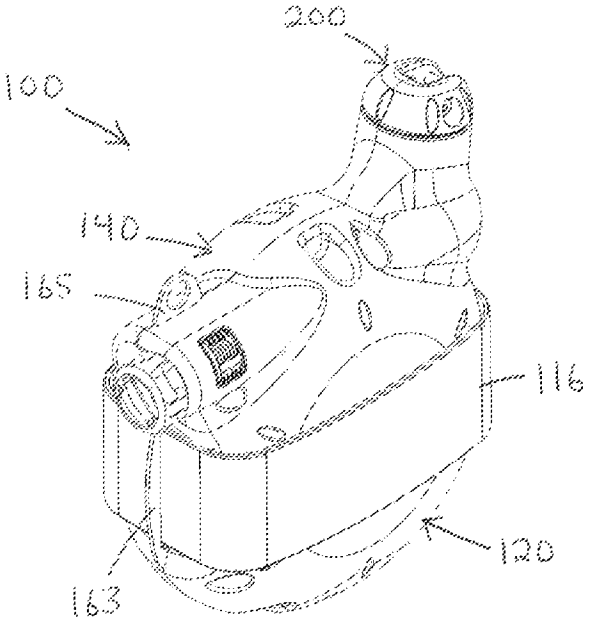
FIG. 2 is a perspective view of one of the exercise apparatus shown in FIG. 1, but without the cord or the carabineer.
Figure 3:
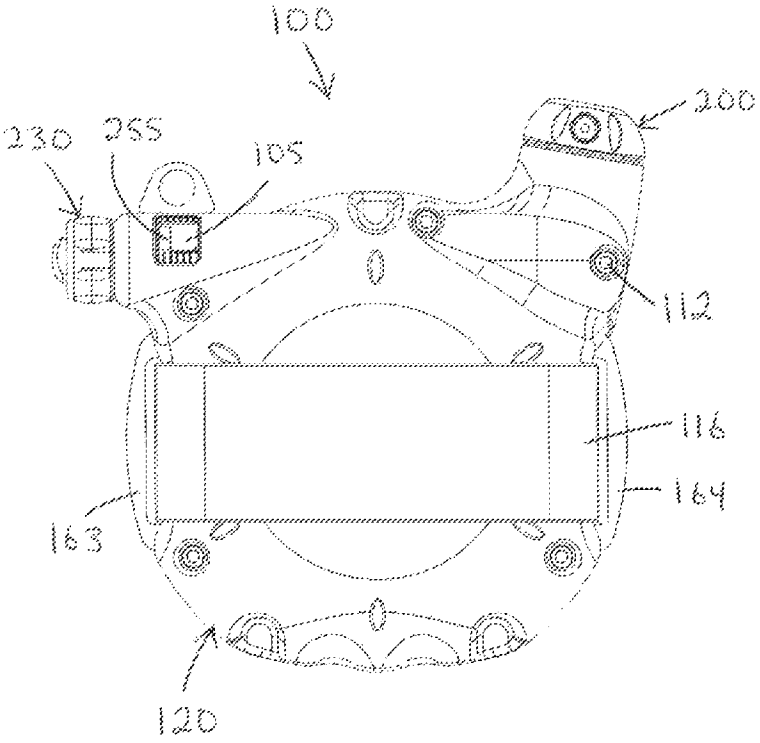
FIG. 3 is a side view of the exercise apparatus of FIG. 2.
Figure 4:
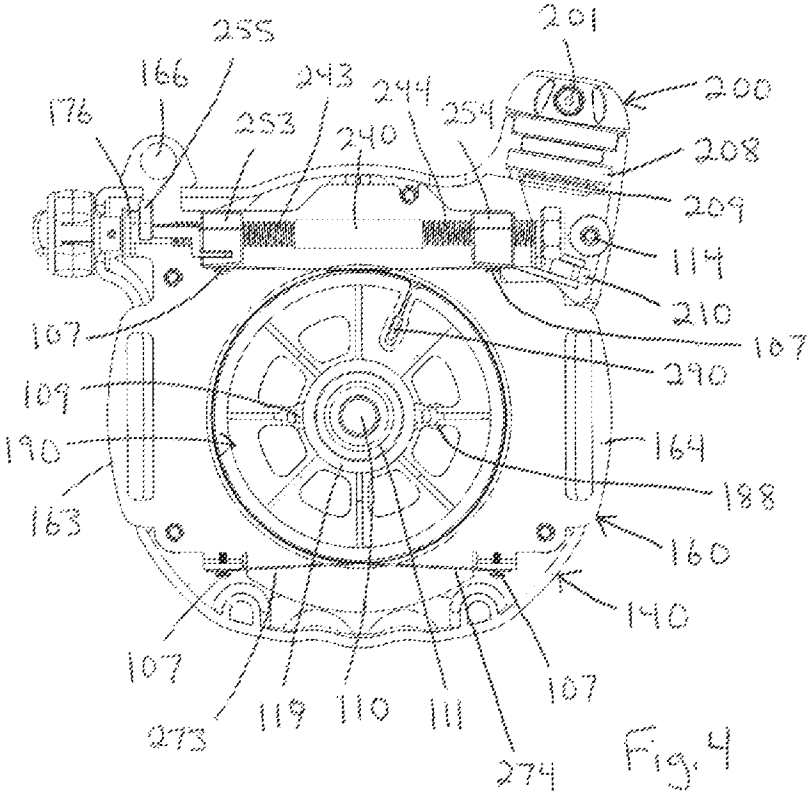
FIG. 4 is the same side view as FIG. 3, but with the near side of the exterior housing removed to illustrate the interior components.
Figure 5:
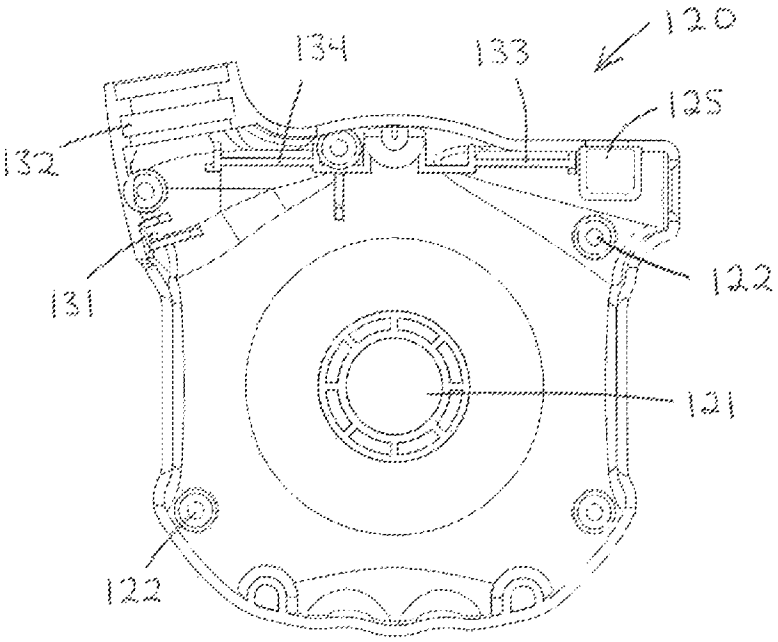
FIG. 5 is an opposite, inside view of the housing component shown in FIG. 3, and removed for FIG. 4.
Figure 6:
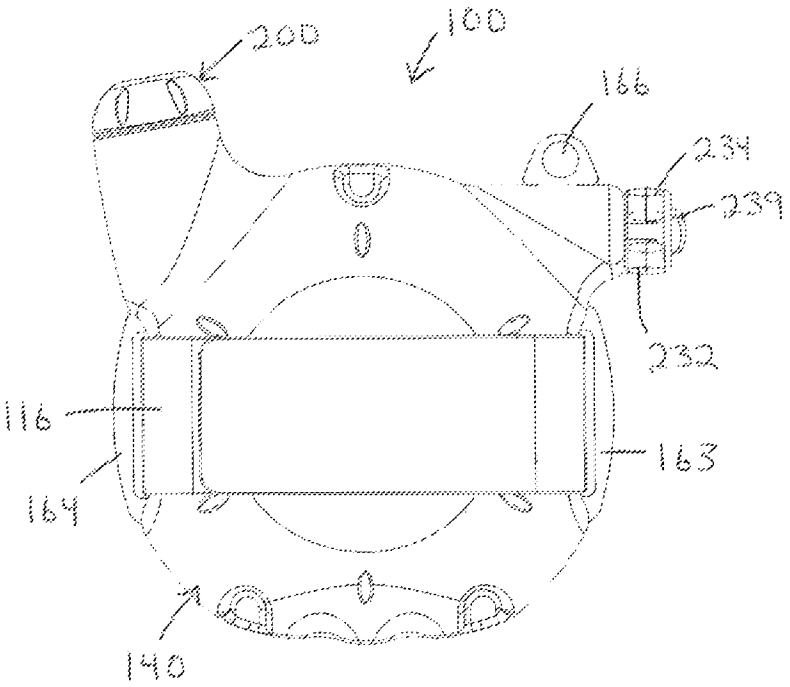
FIG. 6 is an opposite side view of the exercise apparatus of FIG. 2.
Figure 7:
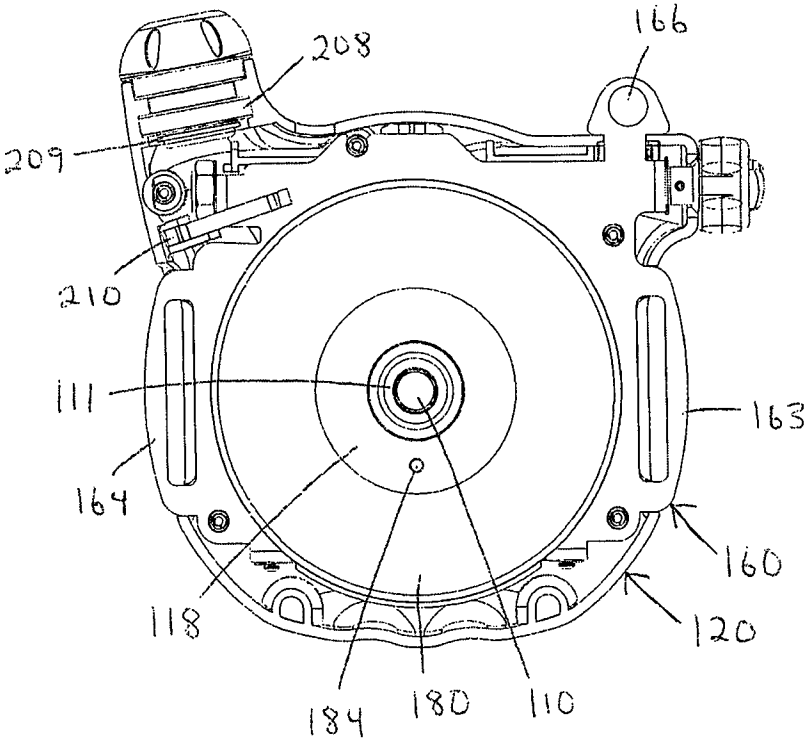
FIG. 7 is the same side view as FIG. 6, but with the near side of the exterior housing removed to illustrate the interior components.
Figure 8:
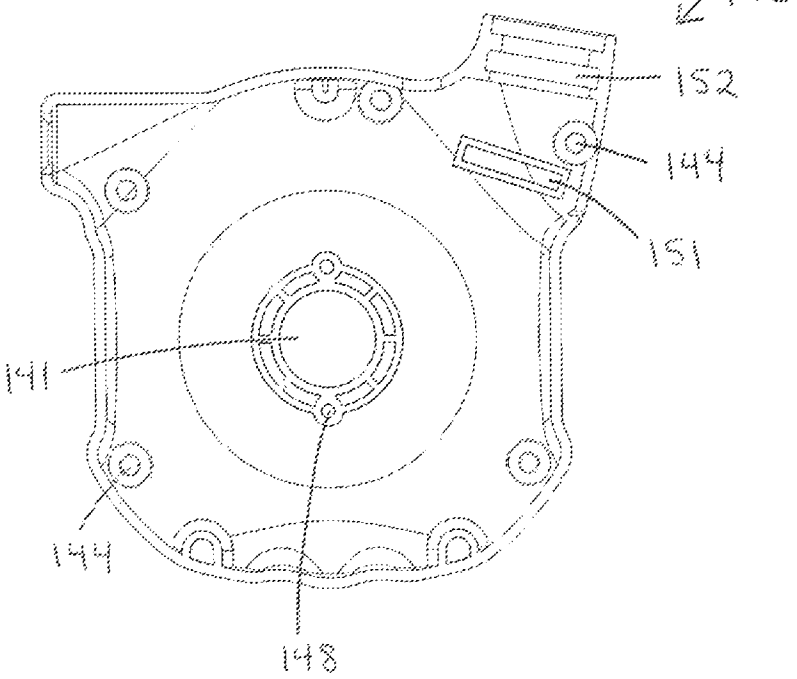
FIG. 8 is an opposite, inside view of the housing component shown in FIG. 6, and removed for FIG. 7.

As shown in FIGS. 4 and 7, the bracket 160 includes a first tab 163 that projects outwardly through a first gap defined between opposing edges of the front housing 120 and the rear housing 140, and a diametrically opposed, second tab 164 that projects outwardly through a second gap defined between opposing edges of the front housing 120 and the rear housing 140. As shown in FIG. 12, each tab 163 and 164 defines an identical slot 161 that is sized and configured to accommodate a section of the strap 116. As shown in FIGS. 2-3 and 6, the ends of the strap 116 are inserted through respective slots 161 and connected to one another in overlapping fashion by hook-and-loop type fasteners. The strap 116 is preferably made of woven Nylon material.

Figure 12:
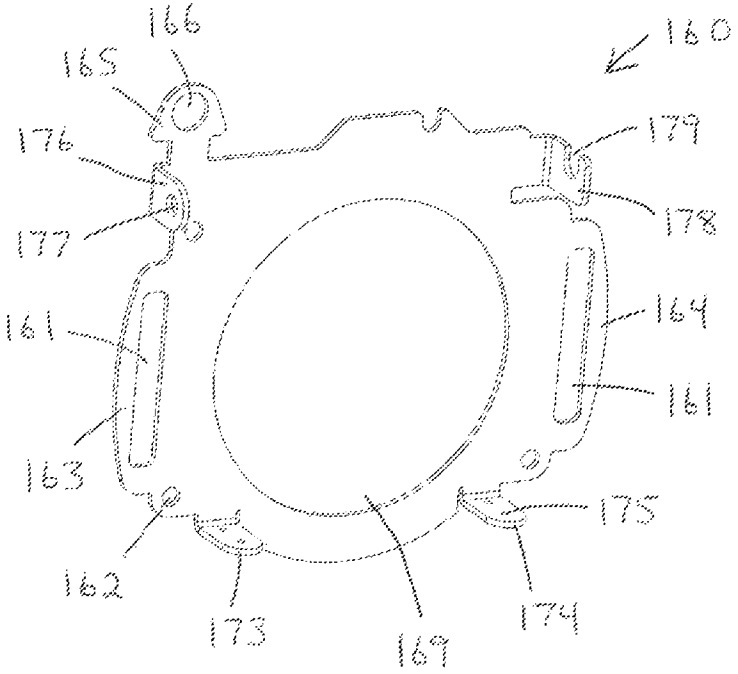
FIG. 12 is a perspective view of a bracket that is part of the exercise apparatus of FIG. 2.

FIG. 12 shows three holes 162 in the bracket 160, through which respective screws 112 are inserted, and a large central opening 169. FIG. 12 also shows a third tab 165 on the bracket 160, and the eyelet 166 that extends through the third tab 165. As shown in FIGS. 4 and 7, the third tab 165 projects outward through a third gap defined between opposing edges of the front housing 120 and the rear housing 140.

Figure 9:
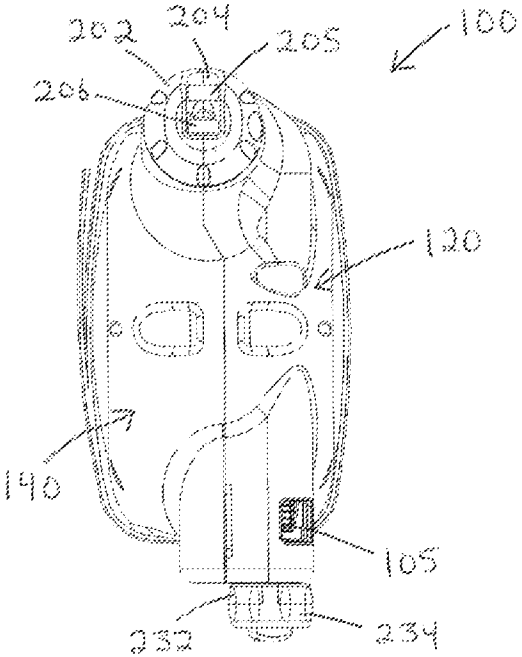
FIG. 9 is a top view of the exercise apparatus of FIG. 2.
Figure 10:
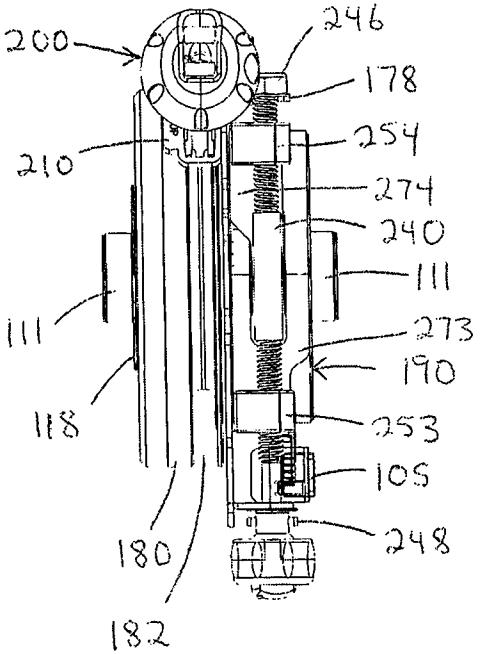
FIG. 10 is the same top view as FIG. 9, but with the front and rear housing components removed to illustrate the interior components.

As shown in FIG. 1, the cord 102 extends from the carabineer 106 into a re-directional bearing 200 rotatably retained between the housings 120 and 140. As shown in FIGS. 9-10, the re-directional bearing 200 includes a base 202 and a centrally located slot 204 extending through an upper forward portion of the base 202. For manufacturing purposes, the base 202 comprises two similar injection molded halves that are secured together by a threaded insert and a screw 201 (see FIGS. 3-4), and also by a commercially available C-clip 209 (see FIGS. 4 and 7). The re-directional bearing 200 also includes a commercially available bearing pack 208 that is mounted onto a bottom stem portion of the base 202 (prior to attachment of the C-clip 209). The front housing 120 includes a half-receptacle 132 (see FIG. 5) for the base 202 and the bearing pack 208, and the rear housing 140 similarly includes a half-receptacle 152 (see FIG. 8) for the base 202 and the bearing pack 208.

The slot 204 extends through a front portion of the base 202 and a top portion of the base 202. A first steel pin 205 is rotatably mounted to the base 202 and extends across a radially outward portion of the slot 204. A second steel pin 206 is rotatably mounted to the base 202 and extends across a radially inward portion of the slot 204. The cord 102 is routed downward between the two pins 205 and 206, and then downward through a forwardly eccentric bore extending through the base 202 (see FIGS. 9-10). The components of the re-directional bearing 200 cooperate to keep the cord 102 bearing against the forward pin 205 as the cord 102 is pulled anywhere in a hemispherical space centered about the rotational axis of the re-directional bearing 200 and bounded by a plane defined by the exposed interface between the base 202 and the housings 120 and 140.

Figure 14:
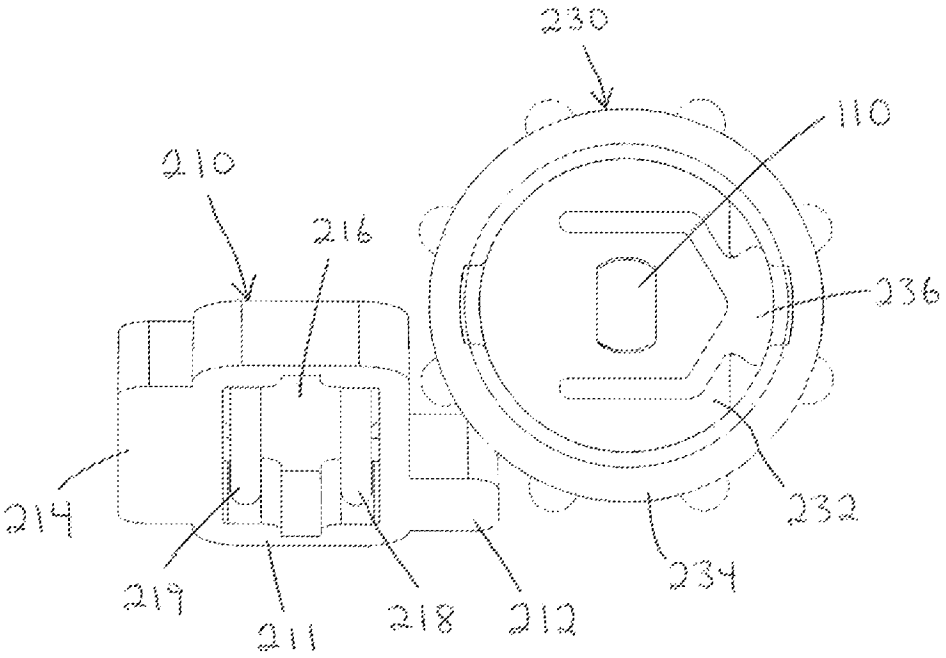
FIG. 14 is an end view of certain internal components of the exercise apparatus of FIG. 2.

The cord 102 extends from the bore in the re-directional bearing 200 to a cord guide 210, which is shown in FIG. 14 (together with components of a knob assembly described elsewhere). The cord guide 210 includes an injection molded base 211 having a first tab 212 that extends in a first direction, and a second tab 214 that extends in an opposite, second direction. A slot 216 extends through the base 211 between the tabs 212 and 214. A first steel pin 218 extends along one longer side of the slot 216, and is rotatably mounted on the base 211. Similarly, a second steel pin 219 extends along an opposite longer side of the slot 216, and is rotatably mounted on the base 211. As shown in FIGS. 5 and 7-8, the cord guide 210 is secured between the housings 120 and 140, with the first tab 212 inserted into a receptacle 131 in the front housing 120 (see FIG. 5), and the second tab 214 inserted into a receptacle 151 in the rear housing 140 (see FIG. 8). A portion of the base 211 adjacent the first tab 212 bears against the bracket 160. The cord 102 is routed downward between the pins 218 and 219 and then about a sheave 180. The pins 218 and 219 cooperate to keep the cord 102 from riding against respective sidewalls of the sheave 180 when the cord 102 is pulled in any plane that extends substantially perpendicular to the bracket 160, thereby rotating the bore out of alignment with the sheave 180.

Portions of the sheave 180 are shown in FIGS. 4, 7, and 10. The sheave 180 is functionally equivalent to the sheave disclosed in the above-referenced Ihli patents, so many of its features are not shown in detail in the accompanying Figures. The sheave 180 includes injection molded opposing sidewalls that define a groove 182 therebetween. The cord 102 has an inner end secured to the sheave 180 at the base of the groove 182, and the cord is wound about the base of the groove 182 and then itself.

A one-way clutch bearing is press-fit into the hub of the sheave 180, and a steel cylindrical shaft 110 is inserted through the one-way clutch bearing. The arrangement is such that the sheave 180 rotates together with the shaft 110 when the cord 102 is pulled from the sheave 180, and the sheave 180 rotates relative to the shaft 110 when the cord is wound back onto the sheave 180.

The sheave 180 includes an injection molded cylindrical cover that snaps onto the outboard sidewall of the groove 182. The cover provides a housing for a concentrically wound, spring steel, recoil spring (not shown). A radially outer end of the spring is connected to the outboard sidewall of the groove 182. An opposite, radially inner end of the spring is connected to the rear housing 140 via a pin 184 (see FIG. 7) inserted into one of eight holes 148 in the rear housing (see FIG. 8). As a result of this arrangement, the spring biases the cord 102 toward a retracted state within the housings 120 and 140, and wound about the sheave 180. In other words, the spring biases the sheave 180 to rotate in a rewind direction relative to the shaft 110, and resists rotation of the sheave 180 together with the shaft 110 during extraction of the cord 102.

As shown in FIG. 7, a first end of the shaft 110 inserts through a bearing pack 111, and a washer 118 is disposed on the shaft 110 between the bearing pack 111 and the sheave 180. The washer 118 is preferably made of Polytetrafluorethylene (PTFE), and may be described as a Teflon™ washer. As shown in FIG. 8, the rear housing 140 includes a reinforced receptacle 141 for the bearing pack 111. Similarly, as shown in FIG. 4, an opposite, second end of the shaft 110 inserts through an identical bearing pack 111, and another Teflon™ washer 119 is disposed on the shaft 110 between the bearing pack 111 and a brake drum 190. As shown in FIG. 5, the front housing 120 includes a reinforced receptacle 121 for the bearing pack 111.

Figure 13:
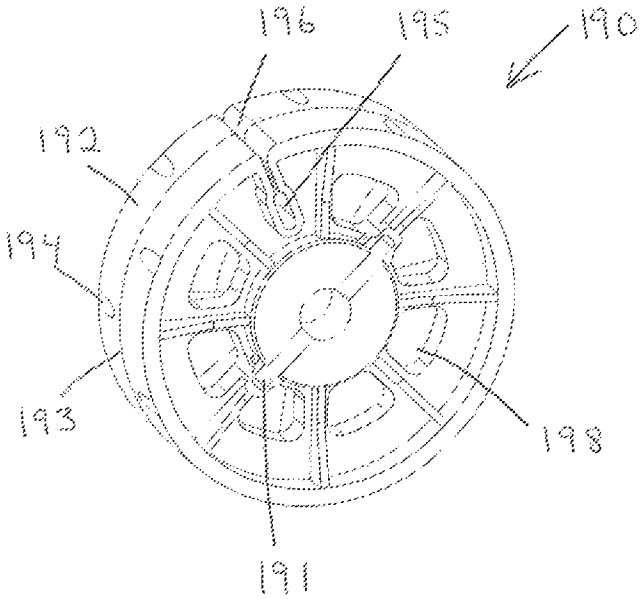
FIG. 13 is a perspective view of a brake drum that is part of the exercise apparatus of FIG. 2.

The injection molded brake drum 190 is shown by itself in FIG. 13. The brake drum 190 is keyed to the shaft 110 and thereby constrained to rotate together with the shaft 110. In this regard, a hole extends transversely through the shaft 110, and a pin 109 (see FIG. 4) is inserted through the hole in the shaft 110. As shown in FIG. 13, the brake drum 190 includes a slot 191 to receive the pin 109 when the pin 109 is pushed half-way through the hole in the shaft 110.

The brake drum 190 defines a circumferential perimeter or bearing surface 192. A circular parting line 193 is centrally located about the bearing surface 192, and the bearing surface 192 angles in opposite directions away from the parting line 193, thereby giving the bearing surface 192 a slightly inverted V-shaped profile. Staggered divots or notches 194 extend into respective lateral edges of the bearing surface 192 at circumferentially spaced locations about the bearing surface 192. The notches 194 and/or the centerline 193 may be described as at least one centering feature that encourages a braking strip 290 to remain centered on the perimeter 192 of the drum 190. A texture pattern may also be applied to the bearing surface 192 to define such a centering feature. The braking strip 290 (see FIG. 4) is preferably made of para-aramid synthetic fiber, and may be described as a Kevlar™ webbing strap. The braking strip 290 has a first end that is folded against itself and sewn into a doubly thick end, and a second end that is terminated in a manner that discourages fraying.

A radially extending slot 195 interrupts the perimeter 192 of the drum 190 and receives the thick end of the braking strip 290. One sidewall of the slot 195 defines a right angle corner with the perimeter 192 of the drum 190, while the opposite sidewall forms a filleted or rounded juncture 196 with the perimeter 192 of the drum 190. The slot 195 is slightly thinner than the braking strip 290 at its radially outward end, and at least twice as wide at its radially inward end. Also, laterally extending ridges extend along the sidewalls bordering the radially outward end of the slot. The thick end of the braking strip 290 is inserted into the radially inward end of the slot 195, and the adjacent thinner portion of the braking strip 290 is inserted into the radially outward end of the slot 195. The subsequent adjacent portion of the braking strip 290 is wrapped about the rounded corner 196 and then around the perimeter 192 of the drum 190. The length of the braking strip 290 is such that the free end may be pulled to the right angle corner of the slot 195, but not into contact with the portion of the braking strip 290 emanating from the slot 195. As a result of this arrangement, the rounded corner 196 pulls the wrapped portion of the braking strip 290 through circles in response to withdrawal of the cord 102 from the sheave 180.

For strength and manufacturing efficiency, the drum 190 is cored to an extent, and holes 198 extend through an intermediate section of the drum 190. The holes 198 align with a cord 102 tie-off point associated with the sheave 180, thereby providing access for replacing the cord 102 with a new cord 102, if and when needed.

As shown in FIG. 4, a first tension band 273 is secured in a generally U-shaped configuration about one half of the braking strip 290 and underlying perimeter 192 of the drum 190, and a second tension band 274 is secured in a generally U-shaped configuration about an opposite half of the braking strip 290 and underlying perimeter 192 of the drum 190. Each tension band 273 and 274 is preferably a strip of stainless spring steel that is formed into a stable U-shaped configuration prior to installation on the unit 100.

A first end of the first tension band 273 is anchored to a fourth tab 173 on the bracket 160 (see FIG. 12). Similarly, a first end of the second tension band 274 is anchored to a fifth tab 174 on the bracket 160 (see FIG. 12). In this regard, first and second holes 175 extend through each tab 173 or 174, and comparable holes extend through the first end of each tension band 273 and 274, and pairs of first and second screws 107 (see FIG. 4) insert through respective tension bands 273 and 274 and thread into respective holes 175. An opposite, second end of the first tension band 273 is anchored to a first steel adjustment nut 253 by means of comparable holes in the nut 273 and the second end of the first tension band 273, and identical first and second screws 107. Similarly, an opposite, second end of the second tension band 274 is anchored to a second steel adjustment nut 254 by means of comparable holes in the nut 274 and the second end of the second tension band 274, and identical first and second screws 107.

The first nut 253 is threaded onto RH threads 243 on a first end of an adjustment bolt 240. The second nut 254 is threaded onto LH threads 244 on an opposite, second end of the adjustment bolt 240. Each nut bears against a respective flat portion of the bracket 160.

The adjustment bolt 240 is rotatably mounted on the bracket 160. In this regard, as shown in FIGS. 4 and 12, the first end of the adjustment bolt 240 is inserted through a hole 177 in a sixth tab 176 on the bracket 160, and an opposite, second end of the adjustment bolt 240 is dropped into a slot 179 in a seventh tab on the bracket. As shown in FIG. 5, rails 133 and 134 on the front housing 120 are configured and arranged to bear against the tops of respective nuts 253 and 254 to prevent the adjustment bolt 240 from rising out of the slot 179. Also, stops are provided at the ends of the rails 133 and 134 to limit axial travel of the nuts 253 and 254 along the adjustment bolt 240.

Figure 11:
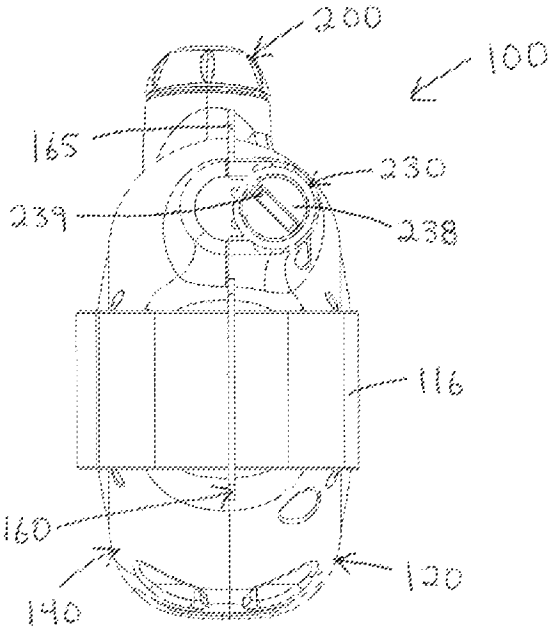
FIG. 11 is an end view of the exercise apparatus of FIG. 2.

A steel and nylon lock nut 246 is threaded onto the second end of the bolt 240, with another Teflon™ washer disposed on the second end of the bolt between the lock nut 246 and the seventh tab 178 on the bracket 160. A knob 230 is keyed (see FIG. 14) and pinned (see pin 248 in FIG. 10) to the first end of the bolt 240, with another Teflon™ washer disposed on the first end of the bolt 240 between the knob 230 and the sixth tab 176 on the bracket 160. The knob 230 and the lock nut 246 cooperate to prevent axial movement of the bolt 240 relative to the bracket 160. The arrangement of the nuts 253 and 254 and the bolt 240 is such that the nuts 253 and 254 move away from one another when the bolt 240 is rotated in a first direction, and move toward one another when the bolt 240 is rotated in an opposite, second direction. In other words, from the perspective of a person facing the unit 100 as shown in FIG. 11, rotation of the knob 230 in a clockwise direction causes the nuts 253 and 254 to move away from one another, thereby increasing resistance to rotation of the drum 190, and rotation of the knob 230 in a counter-clockwise direction causes the nuts 253 and 254 to move toward one another, thereby decreasing resistance to rotation of the drum 190.

The knob 230 is an assembly of four injection molded parts. As shown in FIGS. 6, 11, and 14, the knob 230 includes a base 232 that is keyed to the shaft 110, and pinned to the shaft 110 by pin 248. A two-pronged latch 236 is keyed to the base 232 with the prongs straddling the shaft 110. A dial 238 has a neck portion (not shown) that is rotatably mounted on the end of the shaft 110 (via a cylindrical bore in the neck portion), and that has an octagonal outer profile with opposing sides sized and configured to fit snugly between the prongs of the latch 236. The prongs are leaf springs that discourage rotation of the dial 238, but resiliently deflect to accommodate rotation of the dial 238 relative to the shaft 110 (and the base 232). A cap 234 snaps onto the base 232 to capture the dial 238 and the leaf spring 236, and is keyed to the base 232 for rotation together therewith. A fin on the dial 238 extends in a direction opposite the neck portion to accommodate grasping of the dial 238 between a person's thumb and forefinger. A nub 239 on one end of the fin provides a visual indication of the orientation of the knob 230 and the shaft 110. The dial 238 is selectively rotated relative to the knob 230 and the shaft 110 to recalibrate the orientation of the nub 239 as an indication of relative resistance to rotation of the drum 190 (in increments of 45 degrees).

As shown in FIG. 4, an injection molded indicator finger or pointer 255 is rigidly secured to the adjustment nut 253 by means of one of the screws 107 (and a slot in the nut 253). As a result, the pointer 255 travels linearly together with the nut 253. As shown in FIG. 3, the finger 255 is visible through an injection molded window 105 mounted on the front housing 120 (via adhesive or other known suitable means). FIG. 5 shows a receptacle 125 for the window 105 in the front housing 120. The window 105 includes staggered and alternating hash marks along its upper and lower visible edges. The position of the finger 255 relative to the hash marks on the window 105 indicates a relative range of resistance associated with a revolutionary increment of the knob 230. In other words, the location of the finger 255 provides a macro reading of relative resistance, and the orientation of the indicator 239 provides a micro reading of relative resistance. Each time the knob 230 goes through a revolution, the indicator 239 returns to the same orientation, but the finger 255 moves to a different position relative to the hash marks on the window 105. The adjustability of the dial 238 allows one unit 100 to be calibrated relative to another unit 100 with regard to the micro reading of relative resistance.

Figure 15:
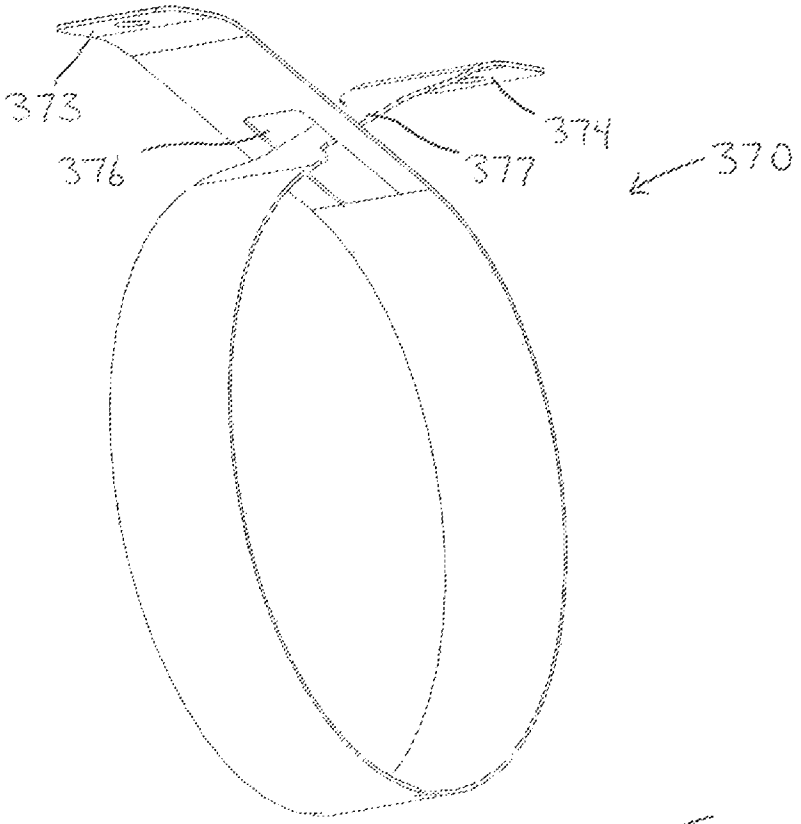
FIG. 15 is a perspective view of an alternative embodiment brake band that may be substituted onto the exercise apparatus of FIG. 2.

FIG. 15 shows an alternative embodiment tension band 370 that is substituted for the tension bands 273 and 274 on an alternative embodiment of the present invention. The tension band 370 has a first end 373 that is screwed to the adjustment nut 253, and an opposite, second end 374 that is screwed to the adjustment nut 254. A slot 376 extends through a first portion of the tension band 370, proximate the first end 373. A portion 377 of the tension band 370, proximate the second end 374, is necked down or narrowed to pass through the slot 376 with minimal clearance. The slot 376 and the narrowed portion 377 allow the tension band 370 to be arranged into a closed loop, in the same general way that the tension bands 273 and 274 are interlaced.

Figure 20:
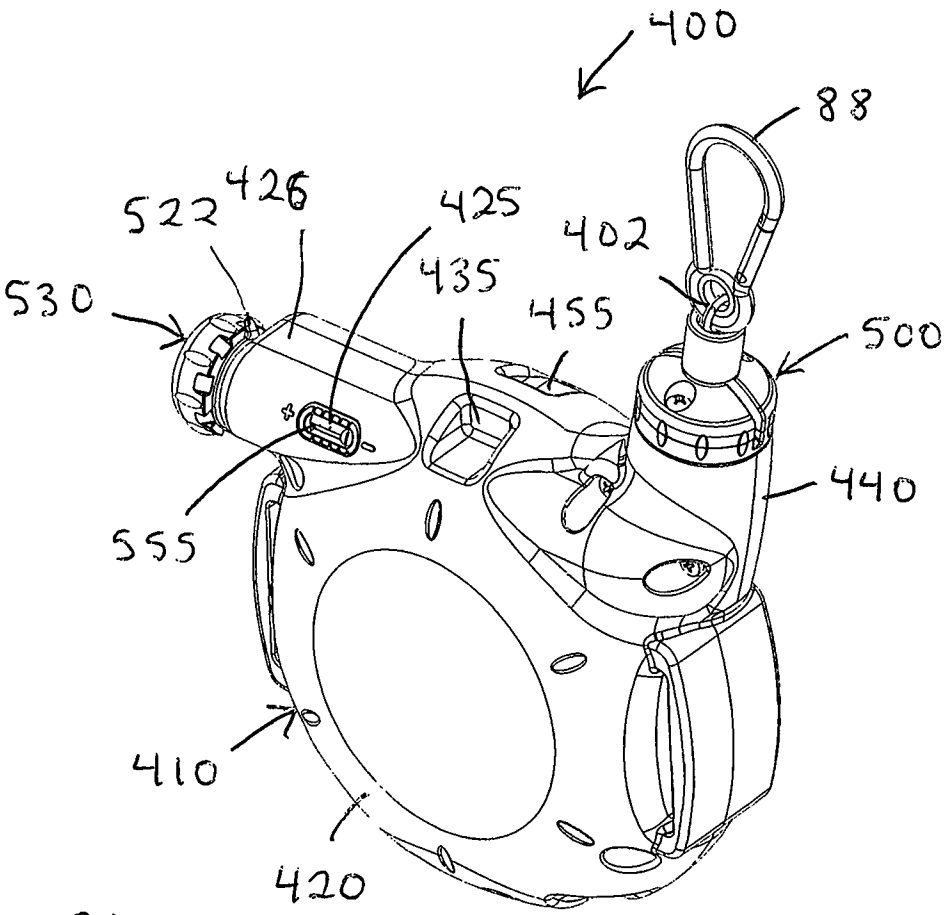
FIG. 20 is a perspective view of an alternative embodiment resistance unit constructed according to the principles of the present invention.

FIG. 20 shows an alternative embodiment resistance module 400. The module 400 preferably includes a shell or frame 410 comprising an injection molded front side housing or shell half 420, an injection molded rear side housing or shell half 440, and a stamped steel bracket 460 (see FIGS. 21, 24, and 16) sandwiched between the housings 420 and 440. In this regard, five threaded inserts are secured in respective receptacles in the rear housing 440, and five screws are inserted through holes in the front housing 420, and past edges of the bracket 460 or through holes in the bracket 460, and threaded into the inserts. Two relatively small holes extend through the bracket 460 and align with relatively small holes in the rear housing 440 to receive relatively small screws for purposes of internally securing the bracket 460 to just the rear housing 440.

Figure 17:
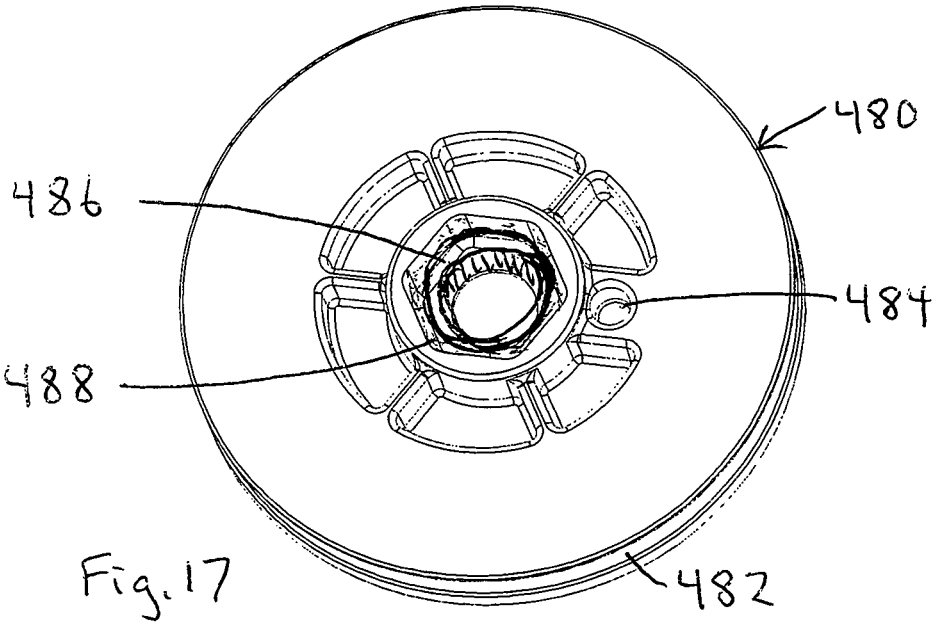
FIG. 17 is an approximately reverse perspective view of some of the components of FIG. 16.

A flexible cord 402 extends through a re-directional bearing 500 rotatably mounted between the two halves 420 and 440 of the shell 410). As further explained below, an inner end of the cord 402 is secured to a sheave 480 (see FIGS. 21 and 17) that is rotatably mounted inside the housing 410, and an intermediate portion of the cord 402 is wrapped in loops inside a groove 482 defined by the sheave 480. A carabineer 88 is secured to an opposite, outer end of the cord 402 by means of at least one knot (preferably hidden beneath a cap). The carabineer 88 is selectively connected to a force receiving member of a desired type in order to perform a desired exercise.

Figure 22:
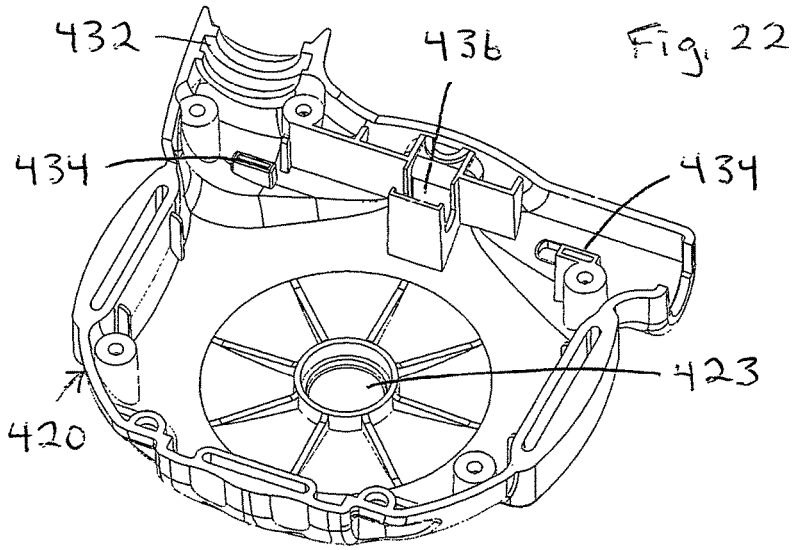
FIG. 22 is a perspective view of the interior of the front housing component of the exercise apparatus of FIG. 20.
Figure 24:
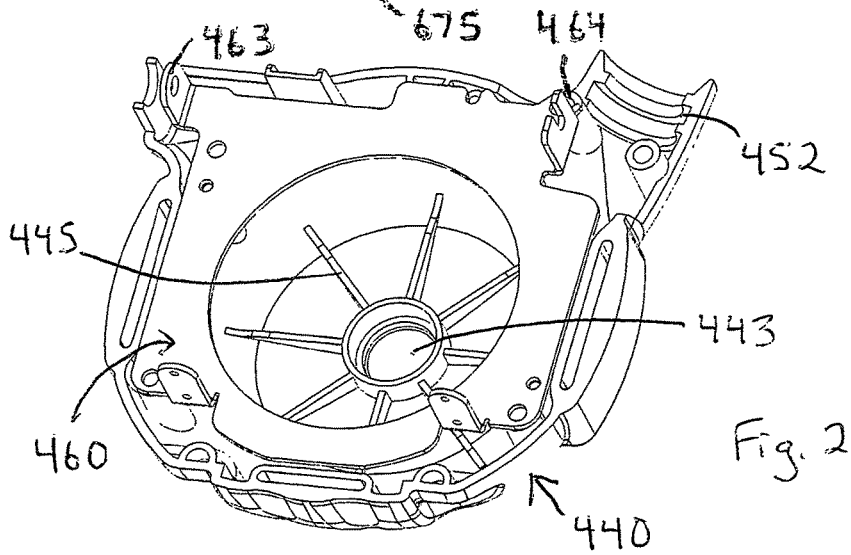
FIG. 24 is a perspective view of the interior of the rear housing component of the exercise apparatus of FIG. 20, with an associated bracket resting on top of it.
Figure 25:
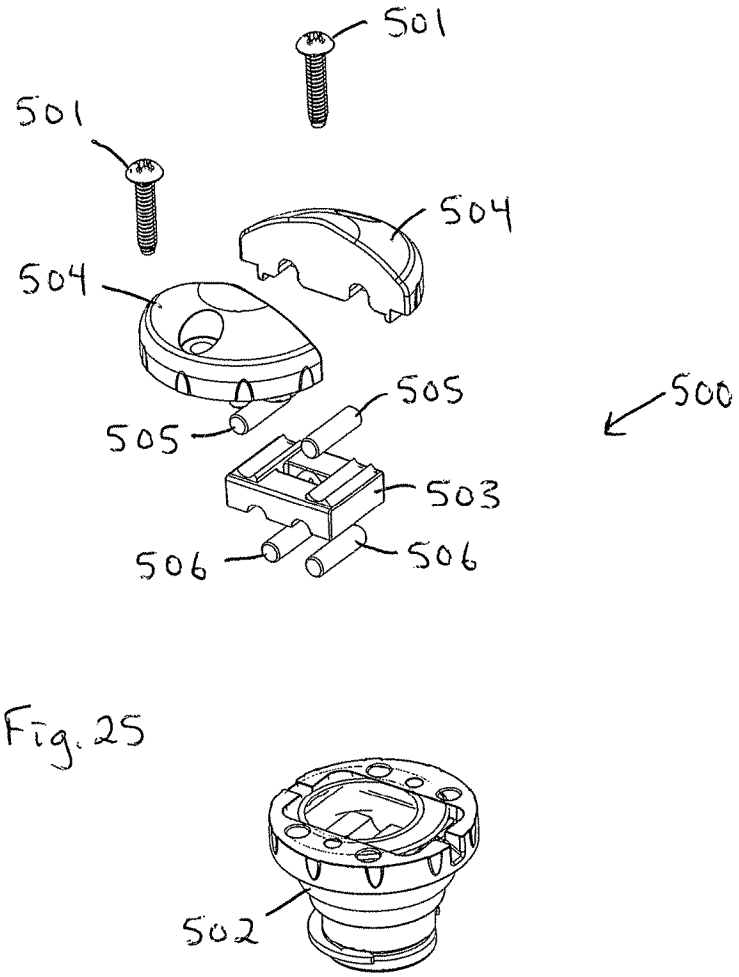
FIG. 25 is an exploded perspective view of a re-directional bearing that is part of the exercise apparatus of FIG. 20.

Components of the re-directional bearing 500 are shown in greater detail in FIG. 25. A commercially available annular bearing pack is press-fit onto a lower "stem" member 502 of the re-directional bearing, and then a conventional C-clip is squeezed onto the lower stem member 502 to retain the bearing pack against axial movement relative thereto. As shown in FIG. 22, the front housing 420 defines a semi-cylindrical receptacle 432 to receive one half of the bearing pack, and as shown in FIG. 24, the rear housing 440 similarly defines a semi-cylindrical receptacle 452 to receive the other half of the bearing pack. The bearing pack accommodates rotation of the stem member 502 about an axis relative to the shell 410.

A middle insert or member 503 of the re-directional bearing 500 is sized and configured to "key" into an upwardly opening compartment in the stem member 502. When installed relative thereto, the insert 503 cooperates with the stem member 502 to define receptacles configured and arranged to rotatably support a lower pair of parallel first and second steel roller pins 506.

Identical first and second top members 504 of the re-directional bearing 500 are sized and configured to "key" into place on top of the stem member 502 (with the insert 503 trapped therebetween). The top members 504 cooperate with the insert 503 to define receptacles configured and arranged to rotatably support an upper pair of parallel first and second steel roller pins 505. The top members 504 are secured to the stem member 502 by respective screws 501. Depending on design considerations, it may be desirable to make the top members 504 from a relatively tougher type of plastic and/or to occasionally replace these top members 504 due to the extensive sliding contact they experience with the cords 402.

Figure 21:
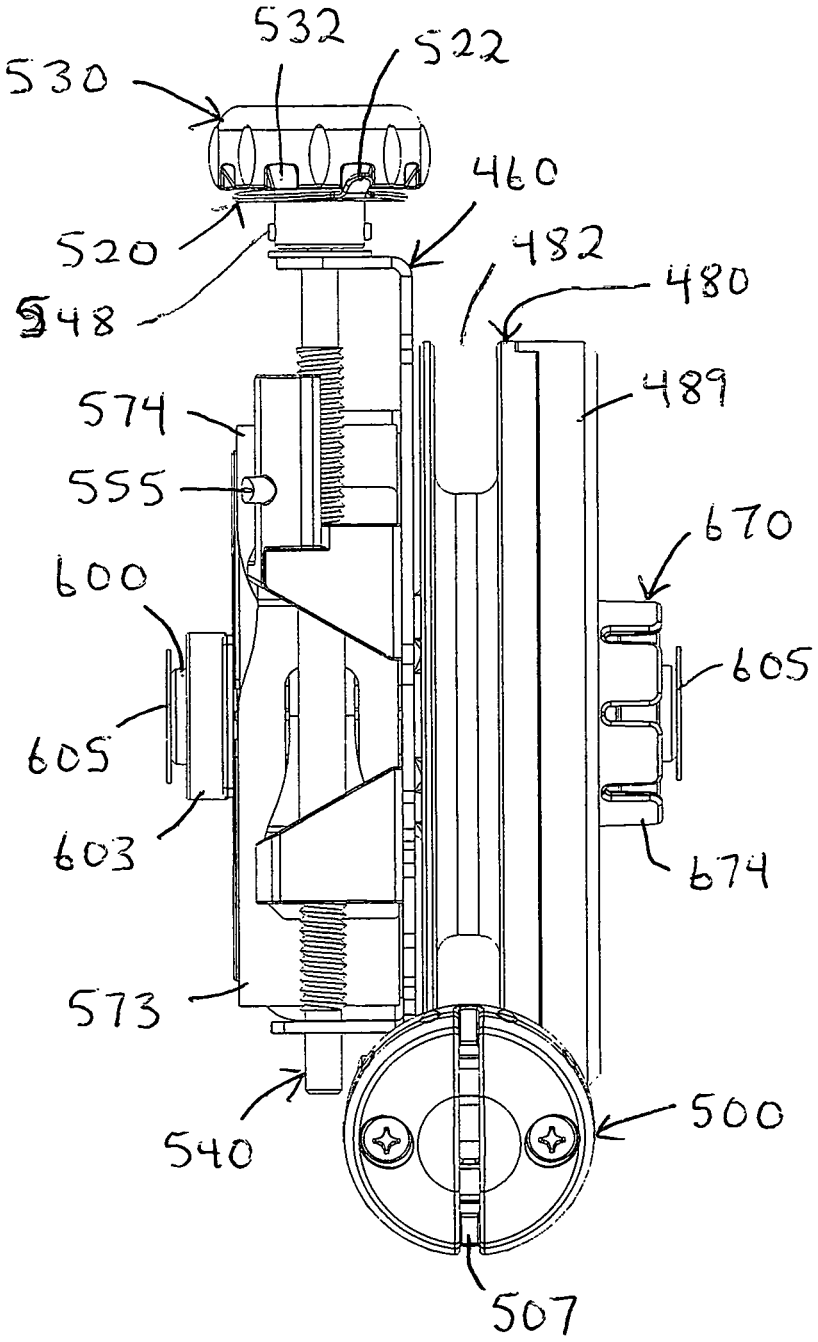
FIG. 21 is a top view of the resistance module of FIG. 20, but with the front and rear housing components removed to illustrate various interior components.

As shown in FIG. 21, the top members 504 are spaced apart from one another in a manner that defines a gap or slot 507 therebetween. In the space between the upper roller pins 505, the slot 507 aligns with slots of similar width extending through the insert 503 and the stem member 502, thereby defining a passageway for the cord 402. In other words, the cord 402 is routed downward between the upper roller pins 505, then between the lower roller pins 506, and then through the base 502. The components of the re-directional bearing 500 cooperate to accommodate pulling of the cord 402 anywhere in a hemispherical space centered about the rotational axis of the re-directional bearing 500 and bounded by a plane defined by the exposed interface between the stem portion 502 and the housings 420 and 440 (and to some extent beyond said plane).

The upper roller pins 505 are spaced relatively further apart than the lower roller pins 506, and axially inward portions of the lower roller pins 506 are visible beneath the upper roller pins 505 in FIG. 21. The upper roller pins 505 are spaced relatively far apart from another to encourage rotation of the re-directional bearing 500 into an orientation where the slot 507 aligns with the direction in which the cord 402 is being pulled. On the other hand, the lower roller pins 506 are spaced relatively closer together to keep the cord 402 from riding against respective sidewalls of the sheave 480 when the cord 402 is pulled in any direction, especially substantially perpendicular to the bracket 460. In other words, when the slot 507 on the re-directional bearing 500 extends perpendicular to the cord groove 482 defined by the sheave 480 (rotated 90 degrees relative to the orientation shown in FIG. 21), the interior edges of the lower pins 506 are inboard relative to the interior sidewalls of the groove 482, so the cord 402 does not ride on a sidewall of the groove 482 as it is being wound or unwound from the sheave 480.

The sheave 480 is injection molded plastic and includes two axially discrete sections. On the more interior half of the sheave 480, closer to the bracket 460 and shown in FIG. 17, the sheave 480 includes opposing sidewalls that define the groove 482 therebetween. An opening 484 extends into the side of the sheave 480 and intersects the base wall of the groove 482 to facilitate securing the inner end of the cord 402 to the sheave 480, preferably by means of at least one knot in the inner end of the cord 402. The cord 402 then winds about the base of the groove 482 and thereafter about itself.

Concentrically inward from the groove 482, a conventional one-way clutch bearing 486 is press-fit into a hexagonal bearing sleeve 488, which in turn is press-fit into a hub portion of the sheave 480. The clutch bearing 486 is sized and configured to receive a steel cylindrical shaft 600 (see FIG. 21) in such a manner that the sheave 480 rotates together with the shaft 600 when the cord 402 is pulled from the sheave 480, and the sheave 480 rotates relative to the shaft 600 when the cord 402 is wound back onto the sheave 480 (by a re-wind spring discussed below).

Figure 16:
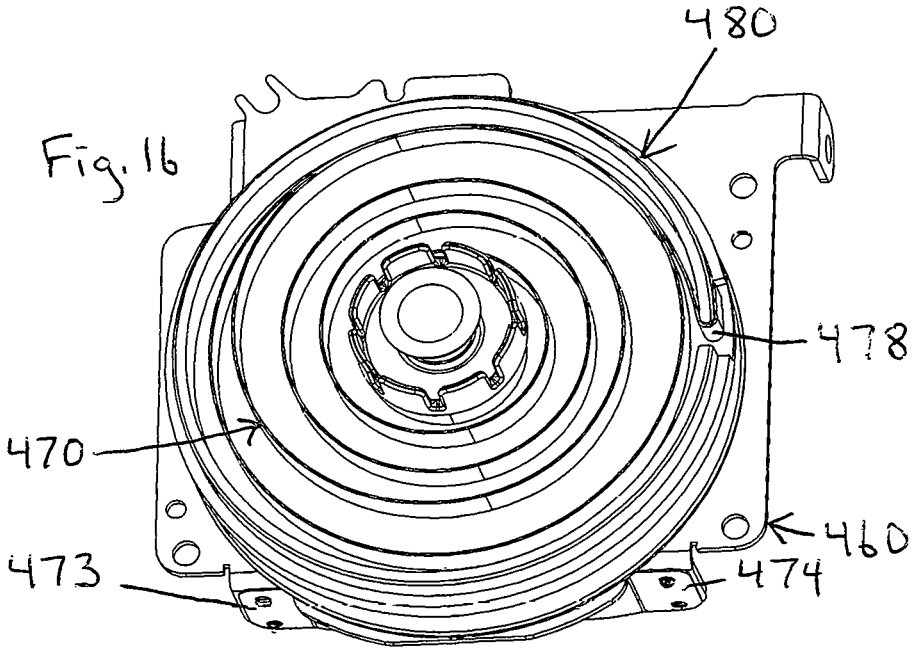
FIG. 16 is a perspective view of certain internal components of the exercise apparatus of FIG. 20.

On the more exterior half of the sheave 480, further from the bracket 460 and shown in FIG. 16, the sheave 480 defines an outwardly opening cylindrical compartment sized and configured to accommodate a spiral wound recoil spring 470. As shown in FIG. 21, an injection molded plastic cover 489 is secured to the sheave 480 to enclose the spring 470 in this compartment. As shown in FIG. 16 a radially outer end 478 of the spring 470 is connected to the peripheral wall of the compartment defined by the sheave 480 and trapped in place by the cover 489. An opposite, radially inner end of the spring 470 is connected to the rear housing 440 via a spring bushing 670 (shown in FIGS. 21, 23, and 16).

The spring bushing 670 is injection molded plastic and includes two axially discrete sections. On the more interior half of the spring bushing 670, closer to the bracket 460 and shown more prominently in FIG. 23, the spring bushing 670 has a relatively smaller diameter hub portion 677. The hub portion 676 defines an opening 677 sized and configured to receive and retain the inner end of the spring 470. The hub portion 676 also defines an otherwise uninterrupted round surface about which the spring 470 can coil. Making efficient use of limited space, this cylindrical surface accommodates the inner end of the spring 470 and relatively strain-free winding and unwinding of the spring 470, while being non-concentrically disposed about the shaft 600.

Figure 23:
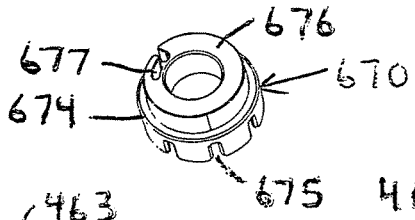
FIG. 23 is a perspective view of a spring bushing that is part of the exercise apparatus of FIG. 20.

On the more exterior half of the spring bushing 670, further from the bracket 460 and shown more prominently in FIGS. 21 and 16, the spring bushing 670 includes a relatively larger diameter exposed end 674. The exposed end 674 is cylindrical in shape and is concentrically disposed about the shaft 600. With reference to FIGS. 23-24, circumferentially spaced and diametrically opposed slits 675 in the spring bushing 670 are sized and configured to engage similarly spaced ribs 445 on the interior of the rear housing halve 440. The slits 675 and the ribs 445 cooperate to "key" the spring bushing 670 in any of eight possible orientations relative to the rear housing 440. As a result of this arrangement, the spring 470 biases the cord 402 toward a retracted state within the shell 410 and wound about the sheave 480. The extent to which the spring biases 470 the sheave 480 to rotate in a rewind direction relative to the shaft 600, and/or resists rotation of the sheave 480 together with the shaft 600 when the cord 402 is pulled from the sheave 480, may be adjusted by changing the orientation of the spring bushing 670 relative to the rear housing half 440.

As shown in FIGS. 22 and 24, each housing 420 and 440 defines a respective, reinforced receptacle 423 or 443 that is sized and configured to receive and retain a respective, conventional roller bearing assembly 603 (see FIG. 21). Each roller bearing assembly 603 is sized and configured to rotatably support a respective end of the shaft 600. Teflon discs 605 are preferable sandwiched between the ends of the shaft 600 and respective housings 420 and 440.

As shown in FIG. 21, a brake assembly is disposed forward of the bracket 460 (opposite the sheave 480). Components of the brake assembly are shown by themselves in FIGS. 18-19. A brake drum 490 is rigidly mounted on the shaft 600 between the sheave 480 and the front end of the shaft 600. Teflon washers are preferably positioned between parts that rotate relative to one another during any phase of operation, including between the brake drum 490 and the sheave 480.

Figure 18:
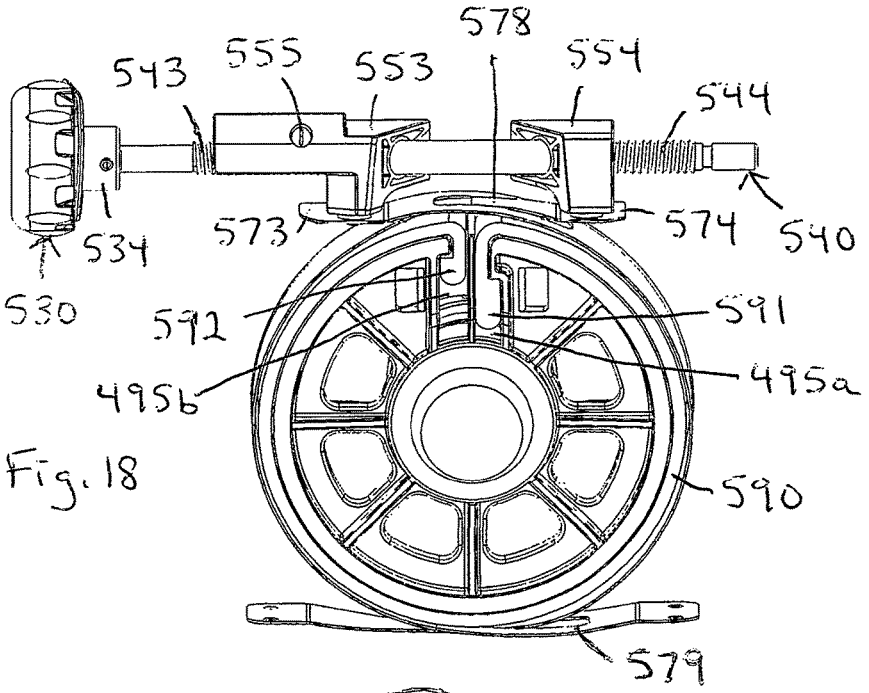
FIG. 18 is a perspective view of certain components of the exercise apparatus of FIG. 20.
Figure 19:
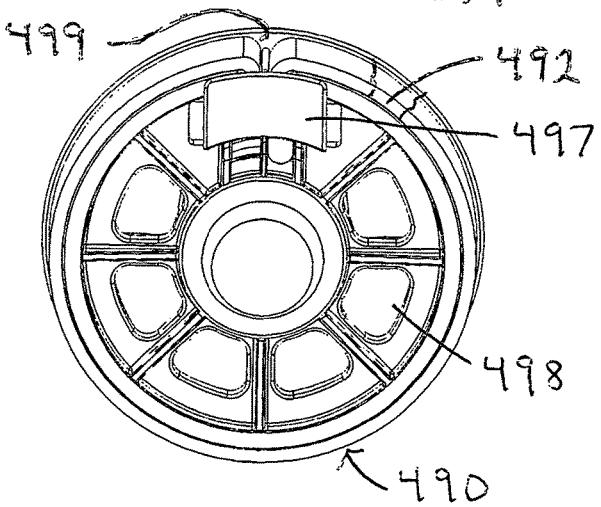
FIG. 19 is a partially fragmented perspective view of a certain components shown in FIG. 18.

The brake drum 490 is injection molded plastic and is keyed to the shaft 410 and thereby constrained to rotate together with the shaft 410. In this regard, a hole extends transversely through the shaft 600, and a pin is inserted through the hole in the shaft 600. On the side opposite what is shown in FIGS. 18-19, the brake drum 490 includes a radially extending slot to receive and lock onto the pin when the pin is pushed half-way through the hole in the shaft 600.

The brake drum 490 defines a circumferential perimeter or bearing surface 492 (beneath the braking strip 590) that is interrupted by a slot divided into two discrete sections 495*a* and 495*b*, or alternatively, by adjacent first and second slots 495*a* and 495*b*. The braking strip 590 is preferably a Kevlar strap or web having a first end portion 591 that is folded against itself and sewn into a doubly thick end, and an opposite, second end portion 592 that also is folded against itself and sewn into a doubly thick end.

A radially outward end of the first slot 495*a* is slightly thinner than the thickness of the braking strip 590, and an opposite, radially inward end of the first slot 495*a* is at least twice as wide as the outward end. The doubled over first end 591 of the braking strip 590 is press fit into the inner end of the first slot 495*a*, and the adjacent thinner portion of the braking strip 590 is press fit into the outer end of the first slot 495*a*. The subsequent adjacent portion of the braking strip 590 is wrapped around the perimeter 492 of the drum 490, beginning in a direction moving away from the second slot 495*b*.

A radially outward end of the second slot 495*b* is wider than the thickness of the braking strip 590, and an opposite, radially inward end of the second slot 495*b* is at least twice as wide as the outward end. The doubled over second end 592 of the braking strip 590 is loosely located inside the inner end of the second slot 495*b*, and the adjacent thinner portion of the braking strip 590 is loosely located inside the outer end of the second slot 495*b*. The braking strip 590 can be relatively taut (from end to end) after being installed in this manner. In operation, the first slot 495*a* pulls the wrapped portion of the braking strip 590 through circles in response to withdrawal of the cord 402 from the sheave 480, and the second slot 495*b* accommodates stretch in the braking strip 590 during use and/or over time.

A radially extending rim or flange 499 bounds an inboard edge of the drum perimeter 492 to discourage the braking strip 590 from drifting inboard. Also, a cap 497 is secured to an opposite, outboard side of the drum 490 to cover the slots 495*a* and 495*b* and discourage the braking strip 590 from drifting outboard. The cap 497 snaps into place via holes 498 adjacent to walls bordering the slots 495*a* and 495*b*. Persons skilled in the art will recognize that the other means, including adhesives or screws, for example, may be used in lieu of or in addition to the snap fit arrangement.

For strength and manufacturing efficiency, the drum 490 is cored to an extent, and additional holes 498 extend through an intermediate section of the drum 490. At least some of the holes 498 align with a cord tie-off point associated with the sheave 480, thereby providing access for replacing the cord 402 with a new cord 402, if and when needed.

As shown in FIG. 18, a first tension band 573 is secured in a generally U-shaped configuration about one-half of the braking strip 590 and underlying perimeter 492 of the drum 490, and a second tension band 574 is secured in a generally U-shaped configuration about an opposite half of the braking strip 590 and underlying perimeter 492 of the drum 490. Each tension band 573 and 574 is preferably a strip of stainless spring steel that is formed into a stable, generally U-shaped configuration prior to installation on the unit 400.

As shown in FIG. 16, a first end of the first tension band 573 is anchored to an anchor tab near a lower left corner of the bracket 460, and extending perpendicularly forward from the main body of the bracket 460. Similarly, a first end of the second tension band 574 is anchored to an identical anchor tab near a lower right corner of the bracket 460. In this regard, first and second holes extend through each tab, and comparable holes extend through the first end of each tension band 573 and 574. Pairs of first and second screws (shown in FIG. 16 but not labeled) insert through respective tension bands 573 and 574 and thread into respective holes.

As shown in FIG. 18, an opposite, second end of the first tension band 573 is anchored to an adjustment member or nut 553 by means of comparable holes in the nut 573 and the second end of the first tension band 573, and identical first and second screws. Similarly, an opposite, second end of the second tension band 574 is anchored to an adjustment member or nut 554 by means of comparable holes in the nut 574 and the second end of the second tension band 574, and identical first and second screws. Each adjustment nut 553 and 554 preferably includes a respective threaded brass insert that is over-molded with injection molded plastic.

Proximate a "6:00 position" in FIG. 18, the second tension band 574 is interrupted by a centrally located slot 579 near the end of the second tension band 574 that connects to the bracket 460. Proximate a "12:00" position in FIG. 18, a similar slot interrupts the first tension band 573 near the end of the first tension band 573 that connects to the adjustment nut 553. Proximate a "12:00 position" in FIG. 18, the second tension band 574 is interrupted by inwardly tapering edges that define a narrower width segment 578 near the end of the second tension band 574 that connects to the adjustment nut 554. Proximate a "6:00 position" in FIG. 18, a similar narrower width segment interrupts the first tension band 573 near the end of the first tension band 573 that connects to the bracket 460. Each narrower width segment is inserted through an opposing slot to "bypass" the bands 573 and 574 relative to one another and form a mostly closed loop of uninterrupted brake band material about the braking strip 590 and the underlying perimeter 492 of the drum 490.

A third adjustment member or bolt 540 has a first section 543 provided with right hand threads and an opposite, second section 544 provided with left hand threads. The first nut 553 is threaded onto the first section 543 of the adjustment bolt 540, and the second nut 554 is threaded onto the second section 544 of the adjustment bolt 540. Each nut 553 and 554 is configured to define one or more bearing surfaces to bear against adjacent bearing surfaces on the frame 410, including for example, respective portions of the bracket 460 and/or the front housing 420.

The adjustment bolt 540 is rotatably mounted on the bracket 460. With reference to FIG. 24, the first end of the adjustment bolt 540 (proximate the end of the first section 543) inserts through a hole in a support tab 463 on the bracket 460, which extends perpendicularly forward from the main body of the bracket 460. As further described below, a knob is mounted on the distal first end of the bolt 540. An opposite, second end of the adjustment bolt 540 (proximate the end of the second section 544) is provided with a smaller radius groove to fit into a slot in another support tab 464 on the bracket 460. As shown in FIG. 22, internal members 434 and 436 on the front housing 420 are configured and arranged to bear against smooth portions of the adjustment bolt 540 as needed to prevent the adjustment bolt 540 from rising out of the slot 479.

With reference to FIGS. 21 and 18, the knob 530 is rigidly secured to the first end of the bolt 540, with a Teflon washer disposed on the first end of the bolt 540 between the knob 530 and the anchor tab 463. The knob 530 and the groove in the opposite end of the bolt 540 cooperate to prevent axial movement of the bolt 540 relative to the bracket 460. The arrangement of the nuts 553 and 554 and the bolt 540 is such that the nuts 553 and 554 move away from one another when the bolt 540 is rotated in a first direction, and move toward one another when the bolt 540 is rotated in an opposite, second direction. In other words, from the perspective of a person to the left of the knob 530 in FIG. 18, rotation of the knob 530 in a clockwise direction causes the nuts 553 and 554 to move away from one another, thereby increasing resistance to rotation of the drum 490, and rotation of the knob 530 in a counter-clockwise direction causes the nuts 553 and 554 to move toward one another, thereby decreasing resistance to rotation of the drum 490.

The knob 530 is an assembly of two injection molded parts. As shown in FIGS. 21 and 18, the knob 530 includes a primary member having a relatively larger diameter outer end that is configured to be grasped and turned by a user, and a relatively smaller diameter inner end 534. The inner end 534 is keyed to the bolt 540, and pinned to the bolt 540 by a spring pin 548. A separate pointer member 520 has an annular base that is rotatably mounted on the inner end 534 of the knob 530, and a tab 522 that projects radially outward from the annular base. The annular base is shaped like a hyperbolic paraboloid and is resiliently squeezed toward a relatively flatter configuration between the larger end 532 of the knob 530 and the proximate sidewall of the shelf 410 (see FIG. 21). The tab 522 is sized and configured to occupy any of several notches 532 formed in the back side of the larger end of the knob 532, and the leaf spring nature of the pointer member 520 encourages the tab 522 to remain in any given notch 532. The tab 522 is selectively rotated relative to the knob 530 (and the bolt 540) to recalibrate the orientation of the tab 522 in relation to the current resistance setting (in increments of 45 degrees).

As shown in FIG. 20, a different sort of pointer member 555 is an integral portion of the adjustment nut 553. As a result, the pointer 555 travels linearly together with the nut 553. The pointer 555 is visible through a slot 425 in the front housing 420, and the position of the pointer 555 relative to the hash marks indicates a relative range of resistance associated with a revolutionary increment of the knob 530. In other words, the location of the pointer 555 provides a macro reading of relative resistance, and the orientation of the tab 522 provides a micro reading of relative resistance (within a given revolution of the knob 530). Each time the knob 530 goes through a revolution, the tab 522 returns to the same orientation, but the pointer 555 moves to a different position relative to the hash marks adjacent to the slot 425. The adjustability of the tab 522 relative to the knob 530 allows one unit 400 to be calibrated relative to another unit 400.

On an alternative embodiment, the pointers 522 and 555 are replaced be an electronic display, a controller, and a power supply. With reference to FIG. 20, the electronic display may take the place of the slot 425 and/or occupy the area designated as 426, with the controller and the power supply disposed internally nearby between the bracket 460 and the rear housing 440. The controller is connected to at least two externally accessible buttons, as well as a conventionally available sensor that tracks rotation of the knob 530. The following flow chart outlines one possible operating routine for the controller:

When Unit Status is: OFF

1. If Power Button is pushed,
   Turn Unit ON

When Unit Status is: ON

1. Display Current Resistance Setting (as a percentage from 03 to 99 in increments of 3)
2. If Power Button is pushed,
   a. Save Current Resistance Setting, and
   b. Turn OFF Unit
3. If Knob is rotated clockwise,
   Add 3 to the Current Resistance Setting for every ⅛ of a revolution (up to a MAX of 99).
4. If Knob is rotated counter-clockwise,
   Subtract 3 from the Current Resistance Setting for every ⅛ of a revolution (down to a MIN of 03).
5. If Other button is pushed,
   Initiate protocol for recalibrating resistance range and/or recalibrating one Unit with another Unit.

The recalibration protocol may take various approaches, may give the user the option of choosing a particular approach, and/or may blend multiple approaches. For example, one protocol would be to prompt the user to set the resistance at maximum and then push the Other button. During subsequent use, the controller would start the display at 99 and then adjust the figure accordingly in response to rotation of the knob. Another protocol would be to prompt the user to set the resistance just above minimum and then push the Other button. During subsequent use, the controller would start the display at 06 and then adjust the figure accordingly in response to rotation of the knob. Yet another protocol would prompt the user to do both of the foregoing in sequential order to establish a range of rotation to adjust from maximum to minimum resistance.

If a direct relationship to pounds of force is desired, another protocol would prompt the user to adjust resistance to the point where a 20-pound weight just begins to pull the cord straight downward out of the housing and then push the Other button. During subsequent use, the controller would start the display at 20 and then adjust the figure accordingly in response to rotation of the knob. Based on experimentation, 20 pounds would correspond to a percentile reading of 36, given that maximum resistance generated by a prototype of the depicted unit 400 is approximately 55 pounds.

If consistency between two units is desired, then one unit 400 would be calibrated in one or more ways set forth above, and then interconnected with the other unit 400 to put the knob of the other unit in a similar position for one or more particular resistance setting(s).

Among other things, the present invention may be described in terms of an exercise apparatus, comprising: a frame; a shaft rotatably mounted on the frame; a sheave mounted to the shaft for rotation in a first direction together with the shaft and rotation in an opposite, second direction relative to the shaft; a spiral rewind spring having a first end and an opposite, second end, wherein the first end is fastened to the sheave; a connector rotatably mounted on the shaft, wherein the connector is operatively interconnected in series between the frame and the second end of the rewind spring; and a cord operatively interconnected in series between the sheave and a force receiving member, wherein the sheave rotates with the shaft in the first direction in response to a user exerting force against the force receiving member, and the sheave rotates relative to the shaft in the second direction in response to the rewind spring exerting force against the sheave.

On certain embodiments of such an exercise apparatus, the connector is nested inside coils of the rewind spring; the connector defines a round perimeter, and the rewind spring coils about the round perimeter; the second end of the spring is disposed inside the perimeter; and the perimeter is a cylinder centered about an axis disposed a distance apart from an axis of rotation defined by the shaft.

In another respect, a housing is preferably disposed about the rewind spring, wherein a first portion of the connector is disposed inside the housing, and a second portion of the connector is disposed outside the housing; and the connector is sized and configured to key into multiple different orientations relative to the housing; and/or the connector defines a round perimeter, and the rewind spring coils about the round perimeter, and the second end of the spring is disposed inside the perimeter.

On other respects, the connector is selectively rotatable relative to the frame to adjust how much rewind force is exerted by the spring; and/or the connector defines a round perimeter, and the rewind spring coils about the round perimeter, and the second end of the spring is disposed inside the perimeter.

Alternatively, the present invention may be described in terms of an exercise apparatus, comprising: a frame; a shaft rotatably mounted on the frame; a first rotating member operatively connected to the shaft for rotation with the shaft in a first direction and for rotation relative to the shaft in an opposite, second direction; a second rotating member rigidly connected to the shaft, wherein one said rotating member is a brake device, and the other said rotating member is a sheave; a spiral rewind spring having an inner end and an opposite, outer end, wherein the outer end is fastened to the sheave; a spring bushing rotatably mounted on the shaft, wherein at least part of the spring bushing is nested inside coils of the rewind spring, and the spring bushing is operatively interconnected in series between the frame and the inner end of the rewind spring, and the spring bushing defines a round perimeter, and the inner end of the rewind spring is disposed inside the perimeter; and a cord operatively interconnected in series between the sheave and a force receiving member, wherein the sheave rotates with the brake device in the first direction in response to a user exerting force against the force receiving member, and the sheave rotates relative to the brake device in the second direction in response to the rewind spring exerting force against the sheave.

On certain embodiments of such an exercise apparatus, the connector is selectively rotatable relative to the frame to adjust how much rewind force is exerted by the spring; the perimeter is a cylinder centered about an axis disposed a distance apart from an axis of rotation defined by the shaft; and/or a housing disposed about the rewind spring, wherein a first portion of the connector is disposed inside the housing, and a second portion of the connector is disposed outside the housing. In the latter instance, the connector is sized and configured to key into multiple different orientations relative to the housing.

In yet another respect, the present invention may be described in terms of a method of displaying a current percentile resistance setting on an exercise apparatus as a percentile of a maximum resistance setting, comprising the steps of: providing an exercise apparatus having a cord that is pulled from a sheave by a user subject to a selectively adjustable level of frictional resistance; establishing at least one baseline percentile resistance setting based on the cord being pulled from the sheave under predetermined circumstances; monitoring subsequent adjustments made to the level of resistance by the user; and displaying a current percentile resistance setting based on said at least one baseline percentile resistance setting and any said adjustments made by the user.

In certain applications, the establishing step involves establishing a first baseline percentile resistance setting based on the cord being pulled from the sheave subject to minimum amount of resistance; and the establishing step involves establishing a first baseline percentile resistance setting based on the cord being pulled from the sheave subject to maximum amount of resistance.

In other applications, the establishing step involves establishing a first baseline percentile resistance setting based on the cord being pulled from the sheave subject to prescribed amount of resistance; and/or the monitoring and displaying steps involve updating a memory location each time resistance is adjusted, and displaying the current percentile resistance setting based on the data currently stored in said memory location. In the latter instance, additional steps include saving previous data stored in said memory location, saving additional data associated with any previous recalibrations of the data stored in said memory location, and using said data to update steps taking to compute the current percentile resistance setting.

In still other applications, additional steps include providing a second said exercise apparatus; and after having connecting one said cord to the other said cord, pulling one said exercise apparatus apart from the other said exercise apparatus under predetermined conditions to synchronize current percentile resistance setting displayed on the one said exercise apparatus with the current percentile resistance setting displayed on the other said exercise apparatus.

The present invention maybe be described as an exercise apparatus, comprising: a frame; a sheave rotatably mounted on the frame, wherein the sheave includes a groove disposed between opposing sidewalls, and the groove has a width measured perpendicularly between the sidewalls; a re-directional bearing movably mounted on the frame, wherein the re-directional bearing includes an inner pair of guides disposed a first distance apart from one another and an outer pair of guides disposed a second distance apart from one another, wherein the first distance is less than the width, and the second distance is greater than the width; a cord operatively interconnected in series between the sheave and a force receiving member, wherein an intermediate portion of the cord extends through the re-directional bearing, including each pair of guides, and the sheave rotates in an operational direction in response to a user exerting force against the force receiving member. The re-directional bearing may be described as rotating about an axis, with each said distance measured perpendicular to the axis. The guides may be described as roller pins.

The present invention may be described as an exercise apparatus, comprising a frame; a sheave rotatably mounted on the frame, wherein the sheave includes a groove disposed between opposing sidewalls, and the groove has a width measured perpendicularly between the sidewalls; a re-directional bearing movably mounted on the frame for rotation about an axis, wherein the re-directional bearing includes a pair of diametrically opposed first and second guides disposed equal distance from the axis and defining a diametrically measured distance therebetween, wherein the distance is greater than the width; and a cord operatively interconnected in series between the sheave and a force receiving member, wherein an intermediate portion of the cord extends through the re-directional bearing, including the guides, and the sheave rotates in an operational direction in response to a user extracting the cord via the force receiving member. The re-directional bearing may include a relatively more internal pair of diametrically opposed first and second guides disposed equal distance from the axis and defining a second diametrically measured distance therebetween, wherein the second distance is less than the width. The re-directional bearing may define first and second cord guiding surfaces that extend perpendicular to said guides and define a second diametrically measured distance therebetween, wherein the second distance is less than the width.

The present invention may be described in terms of an exercise apparatus, comprising a shell having an exterior and defining an interior compartment; a re-directional bearing rotatably mounted on the shell in a manner that defines a passage from the exterior to the interior compartment; a sheave rotatably mounted within the interior compartment, wherein the sheave includes first and second sidewalls that define a groove therebetween; and a cord having a first end portion connected to the sheave and disposed between the surfaces, and an opposite second end portion routed through the passage, wherein the passage is bounded by surfaces that are disposed inboard of the sidewalls for any orientation of the bearing.

The present invention may be described in terms of an exercise apparatus, comprising a frame; a sheave rotatably mounted on the frame, wherein the sheave includes first and second sidewalls that define a groove therebetween; a force receiving member; a cord having a first end portion connected to the sheave and disposed between the sidewalls, and an opposite second end portion connected to the force receiving member; and a re-directional bearing assembly, including a guide member rotatably mounted on the frame, wherein an intermediate portion of the cord is routed through a passage defined by the re-directional bearing assembly, and the passage is bounded by surfaces that are disposed inboard of the sidewalls regardless of how the guide member is oriented relative to the frame.

The subject invention has been described with reference to a preferred embodiment with the understanding that features of the subject invention may be practiced individually and/or in various combinations and/or on various types of exercise equipment. Also, persons skilled in the art will recognize that various modifications may be made to the preferred embodiment, in any of its applications, without departing from the scope of the subject invention. Furthermore, alternative embodiments may be made with different component materials, structures, and/or spatial relationships, and nonetheless fall within the scope of the present invention. In view of the foregoing, the subject invention should be limited only to the extent of the claims set forth below.

What is claimed is:

1. An exercise apparatus, comprising:

a frame;

a drum rotatably mounted on the frame for rotation about an axis, wherein the drum defines a circumferential perimeter that is interrupted by a slot;

at least one tension band disposed about at least a portion of the perimeter of the drum;

a brake strip having a leading end, an opposite, trailing end, and an intermediate portion extending therebetween, wherein the intermediate portion is sandwiched between said at least one tension band and the drum, and each said end occupies the slot, and at least one said end is movable inside the slot;

a tension adjustment mechanism interconnected between said at least one tension band and the frame, and operable to adjust tension in said at least one tension band; and a force receiving member operatively connected to the drum, wherein movement of the force receiving member is linked to rotation of the drum, wherein a wall divides the slot into a first compartment and a second compartment, and each said end of the brake strip occupies a respective said compartment.

2. The exercise apparatus of claim 1, wherein the brake strip comprises a para-aramid synthetic fiber strap, and said at least one tension band comprises at least one steel band.

3. The exercise apparatus of claim 1, wherein the drum includes at least one centering feature that encourages the brake strip to remain centered about the perimeter.

4. The exercise apparatus of claim 1, wherein the leading end is snugly anchored in the slot.

5. The exercise apparatus of claim 1, wherein each said end of the brake strip is doubled against itself to resist extraction from the slot.

6. The exercise apparatus of claim 1, wherein the trailing end is slidably disposed inside the slot in a manner that accommodates changes in length of the brake strip as the brake strip stretches during use.

7. The exercise apparatus of claim 1, wherein a cover is secured across an open side of the slot.

8. The exercise apparatus of claim 1, further comprising a sheave rotatably mounted on the frame, wherein the sheave is operatively connected to the drum to rotate in a first direction together with the drum, and to rotate in an opposite, second direction relative to the drum, and a cord is operatively interconnected between the sheave and the force receiving member to be extracted from the sheave when user force applied against the force receiving member overcomes resistance to rotation of the drum in the first direction, and further comprising a rewind spring interconnected between the sheave and the frame to bias the sheave to rotate in the second direction and rewind extracted cord onto the sheave when rewind force applied by the rewind spring is greater than user applied force against the force receiving member.

9. An exercise apparatus, comprising:

a frame;

a drum rotatably mounted on the frame for rotation about an axis;

a brake member operatively connected to the drum to resist rotation of the drum;

a sheave rotatably mounted on the frame, wherein the sheave has opposing sidewalls that define a groove therebetween, and the sheave is operatively connected to the drum to rotate in a first direction together with the drum, and to rotate in an opposite, second direction relative to the drum;

a force receiving member;

a cord having an inner end portion connected to the sheave and disposed between the first and second sidewalls, and an opposite, outer end portion connected to the force receiving member; and a re-directional assembly rotatably mounted on the frame, wherein the re-directional assembly defines a passage bounded by surfaces that are disposed inboard of the opposing sidewalls regardless of how the cord is angled relative to the frame, and an intermediate portion of the cord is routed through the passage, wherein the groove has a width measured perpendicularly between the opposing sidewalls, and the re-directional assembly includes an inner pair of guides disposed a first distance apart from one another, and an outer pair of guides disposed a second distance apart from one another, wherein the first distance is less than the width, and the second distance is greater than the width, and the inner pair of guides define opposing first and second said surfaces.

10. The exercise apparatus of claim 9, wherein the re-directional assembly rotates about a guide axis relative to the frame, and each said distance is measured perpendicular to the guide axis.

11. The exercise apparatus of claim 9, wherein the re-directional assembly includes a guide member, and the guides are roller pins rotatably mounted on the guide member.

12. The exercise apparatus of claim 11, wherein the guide member defines opposing third and fourth said surfaces on respective, opposite sides of the passage, and a third distance is measured perpendicularly between the third and fourth said surfaces, and the third distance is less than the width.

13. The exercise apparatus of claim 12, wherein the roller pins extend perpendicular to the third and fourth said surfaces.

14. The exercise apparatus of claim 9, wherein the frame includes a shell that defines an interior and an exterior, and the drum and the sheave occupy the interior, and the re-directional assembly is rotatably mounted on the shell, and the passage extends between the exterior and the interior.

15. The exercise apparatus of claim 14, wherein the shell is sized and configured to be held in a person's left hand when the apparatus is being used for its intended purpose.

* * * * *